US007705811B2

(12) United States Patent
Lee et al.

(10) Patent No.: US 7,705,811 B2
(45) Date of Patent: Apr. 27, 2010

(54) LIGHT EMITTING DISPLAY DEVICE AND METHOD OF DRIVING THE SAME

(75) Inventors: Jae Sung Lee, Seoul (KR); Young Jong Park, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 954 days.

(21) Appl. No.: 11/413,708

(22) Filed: Apr. 28, 2006

(65) Prior Publication Data

US 2006/0244697 A1 Nov. 2, 2006

(30) Foreign Application Priority Data

Apr. 28, 2005 (KR) ..... 10-2005-0035784

(51) Int. Cl.
*G09G 3/30* (2006.01)

(52) U.S. Cl. ..... 345/77; 345/207; 345/691

(58) Field of Classification Search ..... 345/76–81, 345/82, 204, 207, 691; 315/149, 169.3
See application file for complete search history.

(56) References Cited

U.S. PATENT DOCUMENTS

2002/0011978 A1 1/2002 Yamazaki et al.
2002/0186230 A1 12/2002 Kudo et al.
2003/0058202 A1* 3/2003 Evanicky et al. ..... 345/82
2003/0215853 A1 11/2003 Lynn et al.
2004/0036708 A1* 2/2004 Evanicky et al. ..... 345/691
2004/0155593 A1 8/2004 Kim et al.
2004/0252083 A1* 12/2004 Watanabe et al. ..... 345/74.1
2005/0023986 A1* 2/2005 Mizukoshi et al. ..... 315/169.3
2005/0030264 A1* 2/2005 Tsuge et al. ..... 345/76

(Continued)

FOREIGN PATENT DOCUMENTS

CN 1577446 A 2/2005

(Continued)

OTHER PUBLICATIONS

Patent Abstracts of Japan, Publication No. 05-088655; Publication Date: Apr. 9, 1993; in the name of Yoshi et al.

(Continued)

*Primary Examiner*—Amare Mengistu
*Assistant Examiner*—Dmitriy Bolotin
(74) *Attorney, Agent, or Firm*—Christie, Parker & Hale, LLP

(57) ABSTRACT

A light emitting display device for controlling brightness according to peripheral light brightness and emission amount of a display region. The light emitting display device includes a display region including a pixel adapted to emit light in response to data, scan, and emission control signals, a controller for controlling brightness of the display region, a scan driver for supplying the scan signal and controlling a signal width of the emission control signal according to a signal from the controller, a data driver for transmitting the data signal corresponding to video data, the data signal being corrected using a gamma correcting signal from the controller, and a power source supply unit for supplying power to the display region. The controller outputs the gamma correcting signal corresponding to peripheral light and controls an amount of current supplied to the display region according to a sum of the video data in one frame.

14 Claims, 9 Drawing Sheets

U.S. PATENT DOCUMENTS

| | | | | |
|---|---|---|---|---|
| 2005/0057580 | A1* | 3/2005 | Yamano et al. | 345/690 |
| 2005/0243077 | A1* | 11/2005 | Chung et al. | 345/204 |

FOREIGN PATENT DOCUMENTS

| | | | |
|---|---|---|---|
| JP | 5-88655 | | 4/1993 |
| JP | 11-175027 | | 7/1999 |
| JP | 11-194739 | | 7/1999 |
| JP | 2000-221944 | | 8/2000 |
| JP | 2000-293133 | | 10/2000 |
| JP | 2002-366112 | | 12/2002 |
| JP | 2003-195816 | | 7/2003 |
| JP | 2003-308046 | | 10/2003 |
| JP | 2004-151187 | | 5/2004 |
| JP | 2004-361816 | | 12/2004 |
| JP | 2005-055726 | | 3/2005 |
| KR | 2000-0033177 | | 6/2000 |
| WO | WO 2004/023446 | A1 | 3/2004 |
| WO | WO 2004/051616 | A2 | 6/2004 |
| WO | WO 2005/006291 | A1 | 1/2005 |

OTHER PUBLICATIONS

Patent Abstracts of Japan, Publication No. 11-194739; Publication Date: Jul. 21, 1999; in the name of Masuda.

Patent Abstracts of Japan, Publication No. 2003-195816; Publication Date: Jul. 9, 2003; in the name of Hasegawa.

Patent Abstracts of Japan, Publication No. 2003-308046; Publication Date: Oct. 31, 2003; in the name of Inoue et al.

SIPO Office action dated Jul. 4, 2008, for corresponding Chinese application 200610066029.5, with English translation indicating relevance of WO and CN references listed in this IDS.

Patent Abstracts fo Japan, Publication No. 2000-221944, dated Aug. 11, 2000, in the name of Koji Ogusu, et al.

Korean Patent Abstracts, Publication No. 1020000033177 A, dated Jun. 15, 2000, in the name of Hak Su Kim,e t al.

Chinese Office action, with English translation, dated Mar. 27, 2009 for corresponding Chinese Patent Application No. 2006100660295 listing the cited reference.

Japanese Office action dated Aug. 18, 2009, for corresponding Japanese application 2005-316860, noting listed references in this IDS, as well as JP 2005-055726 and JP 2004-361816 previously filed in an IDS dated Sep. 4, 2008.

European Search Report dated Nov. 3, 2009, for corresponding European application 06251599.4, noting listed references in this IDS, as well as U.S. Publications 2005/0023986 and 2005/0243077 previously cited in U.S. Office action dated Feb. 27, 2009.

* cited by examiner

FIG .8

| UPPER 5-BIT VALUE | EMISSION RATE | EMISSION RATIO | BRIGHTNESS | EMISSION CONTROL SIGNAL WIDTH |
|---|---|---|---|---|
| 0 | 0% | 100% | 300 | 325 |
| 1 | 4% | 100% | 300 | 325 |
| 2 | 7% | 100% | 300 | 325 |
| 3 | 11% | 100% | 300 | 325 |
| 4 | 14% | 100% | 300 | 325 |
| 5 | 18% | 100% | 300 | 325 |
| 6 | 22% | 100% | 300 | 325 |
| 7 | 25% | 100% | 300 | 325 |
| 8 | 29% | 100% | 300 | 325 |
| 9 | 33% | 100% | 300 | 325 |
| 10 | 36% | 100% | 300 | 325 |
| 11 | 40% | 99% | 297 | 322 |
| 12 | 43% | 98% | 295 | 320 |
| 13 | 47% | 96% | 287 | 311 |
| 14 | 51% | 93% | 280 | 303 |
| 15 | 54% | 89% | 268 | 290 |
| 16 | 58% | 85% | 255 | 276 |
| 17 | 61% | 81% | 242 | 262 |
| 18 | 65% | 76% | 228 | 247 |
| 19 | 69% | 72% | 217 | 235 |
| 20 | 72% | 69% | 206 | 223 |
| 21 | 76% | 65% | 196 | 212 |
| 22 | 79% | 62% | 186 | 202 |
| 23 | 83% | 60% | 179 | 194 |
| 24 | 87% | 57% | 172 | 186 |
| 25 | 90% | 55% | 165 | 179 |
| 26 | 94% | 53% | 159 | 172 |
| 27 | 98% | 51% | 152 | 165 |
| 28 | – | – | – | – |
| 29 | – | – | – | – |
| 30 | – | – | – | – |
| 31 | – | – | – | – |

LIGHT EMITTING DISPLAY DEVICE AND METHOD OF DRIVING THE SAME

CROSS-REFERENCE TO RELATED APPLICATIONS

This application claims priority to and the benefit of Korean Patent Application No. 10-2005-0035784, filed on Apr. 28, 2005, in the Korean Intellectual Property Office, the entire disclosure of which is incorporated herein by reference.

BACKGROUND

1. Field of the Invention

The present invention relates to a light emitting display device and a method of driving the same, and more particularly to, a light emitting display device capable of controlling brightness in accordance with brightness of peripheral light and the total amount of emission of a display region and a method of driving the same.

2. Discussion of Related Art

Recently, various small and light flat panel displays (FPD) having reduced weight and volume that overcome the disadvantages of cathode ray tubes (CRT) have been developed. In particular, light emitting display devices having high emission efficiency, brightness, viewing angles, and response speed are in the spotlight.

Light emitting display devices can be classified as an organic light emitting display device using organic light emitting diodes (OLEDs) and an inorganic light emitting display device using inorganic light emitting diodes. An OLED includes an anode electrode, a cathode electrode, and an organic emission layer positioned between the anode electrode and the cathode electrode to emit light by combination of electrons and holes. The inorganic light emitting diode referred to as a light emitting diode (LED) includes an inorganic emission layer, for example, an emission layer formed of a PN junction of semiconductor material unlike the OLED.

FIG. 1 illustrates the structure of a conventional light emitting display device.

Referring to FIG. 1, the conventional light emitting display device includes a display region 10, a power source supply unit 30, a scan driver 40, and a data driver 50.

The display region 10 includes n×m pixels 5 each including an electroluminescent (EL) device (or light emitting device, not shown), n scan lines S1, S2, . . . , and Sn and n emission control lines E1, E2, . . . , and En formed in a row direction to respectively transmit scan signals and emission control signals, and m data lines D1, D2, . . . , and Dm formed in a column direction to transmit data signals. The display region 10 emits light from the EL devices (not shown) using the scan signals, the emission control signals, and the data signals to display images.

The power source supply unit 30 provides a first power source ELVdd and a second power source ELVss having a potential lower than the potential of the first power source ELVdd, to the display region 10 so that currents corresponding to the data signals flow to pixels 5, respectively, in accordance with a difference in voltage between the first power source ELVdd and the second power source ELVss.

The scan driver 40 outputs scan signals to apply the scan signals to the scan lines S1, S2, . . . , and Sn and outputs emission control signals to apply the emission control signals to the emission control lines E1, E2, . . . , and En.

The data driver 50 is connected to the data lines D1, D2, . . . , and Dm to apply the data signals to the display region 10.

According to the conventional light emitting display device having the above structure, the pixels 5 emit light at uniform brightness regardless of peripheral brightness, which is the brightness of peripheral light (i.e., light of a region around the display). Therefore, when the same gray scales are displayed, the clarity of the image displayed when the peripheral brightness is high is less than the clarity of the image displayed when the peripheral brightness is low. Also, when many pixels 5 emit light with high brightness in the light emitting display device, the amount of current supplied to the display region 10 increases so that heavy load is applied to the power source supply unit 30, thereby requiring the power source supply unit 30 to provide high output.

SUMMARY OF THE INVENTION

Accordingly, it is an aspect of the present invention to provide a light emitting display device capable of controlling brightness in response to the brightness of peripheral light and the amount of emission of a display region to reduce power consumption and to improve picture quality and a method of driving the same.

The foregoing and/or other aspects of the present invention are achieved by providing a light emitting display device including a display region including a pixel adapted to emit light in response to a data signal, a scan signal, and an emission control signal, a controller for controlling brightness of the display region, a scan driver for supplying the scan signal and for controlling a signal width of the emission control signal in accordance with a signal output from the controller, a data driver for supplying the data signal corresponding to video data, the data signal being corrected using a gamma correcting signal output from the controller, and a power source supply unit for supplying power to the display region. The controller outputs the gamma correcting signal corresponding to peripheral light and controls an amount of current supplied to the display region in accordance with a sum of the video data in one frame.

According to another aspect of the present invention, a method of driving a light emitting display device that emits light in response to a current that flows through a display region, is provided. The method includes controlling a data signal corresponding to video data in response to brightness of peripheral light, generating frame data obtained by summing the video data in one frame, and controlling an amount of current transmitted to the display region in accordance with the frame data.

BRIEF DESCRIPTION OF THE DRAWINGS

These and/or other aspects and features of the invention will become apparent and more readily appreciated from the following description of the exemplary embodiments, taken in conjunction with the accompanying drawings of which:

FIG. 8 illustrates a look-up table in the emission controller of FIG. 7 according to an exemplary embodiment of the present invention.

DETAILED DESCRIPTION

Hereinafter, a light emitting display device according to exemplary embodiments of the present invention will be described with reference to FIGS. 2 to 9.

Figure 1:
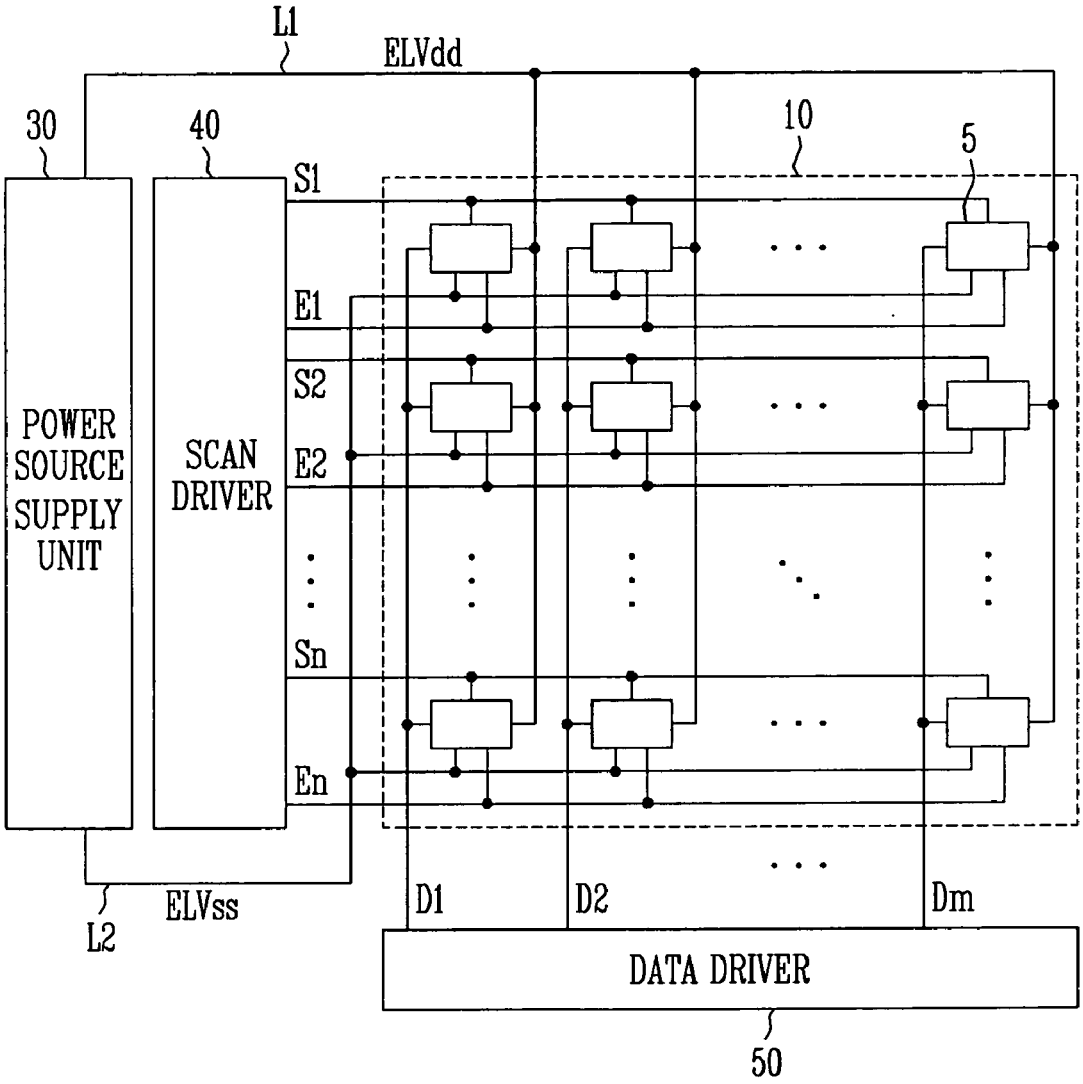
FIG .1 (PRIOR ART)
FIG. 1 illustrates the structure of a conventional light emitting display device.
Figure 2:
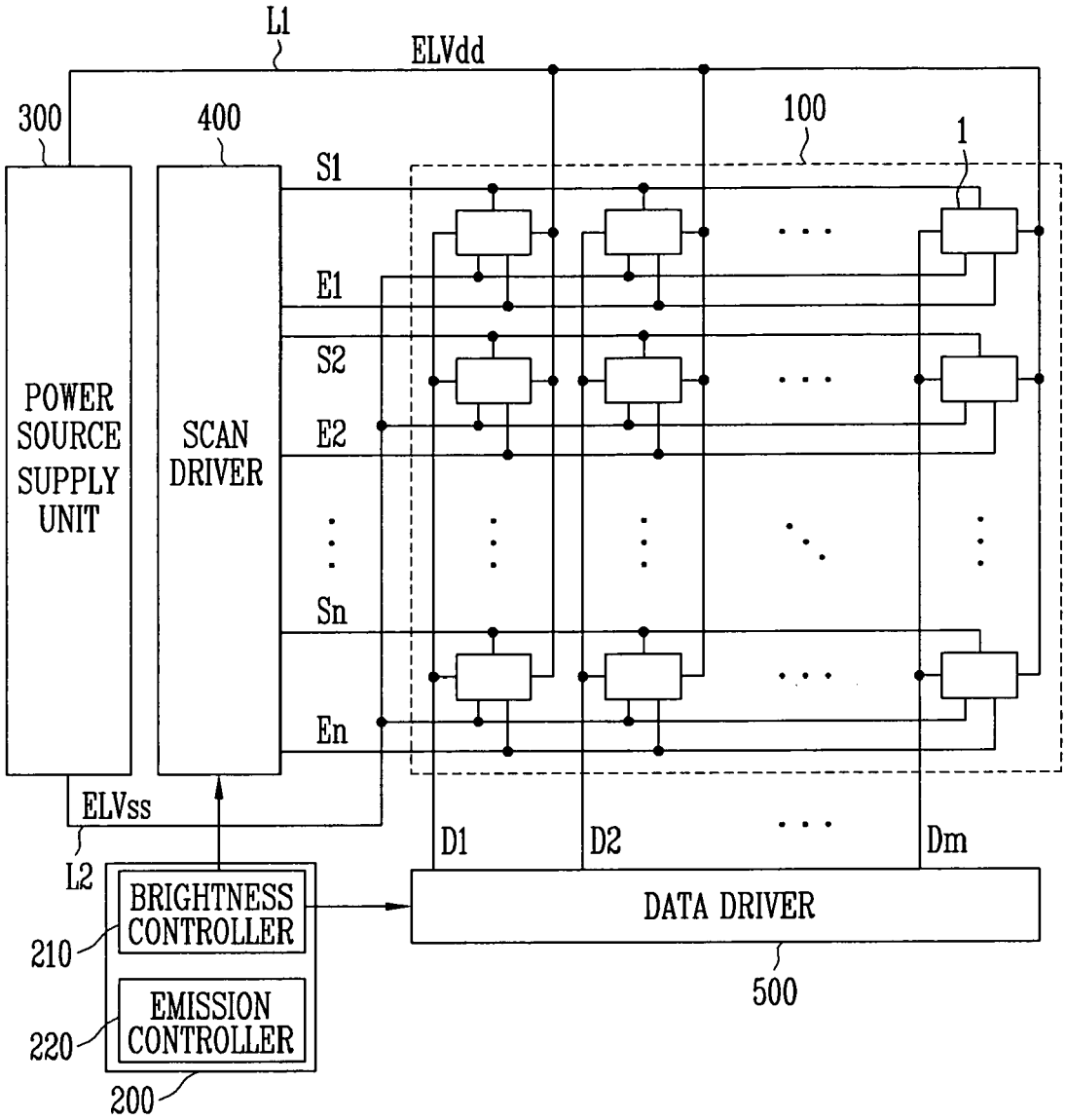
FIG. 2 illustrates a light emitting display device according to an exemplary embodiment of the present invention.

FIG. 2 illustrates a light emitting display device according to an exemplary embodiment of the present invention.

Referring to FIG. 2, the light emitting display device includes a display region 100, a controller 200, a power source supply unit 300, a scan driver 400, and a data driver 500.

The display region 100 includes a plurality of pixels 1 that are electrically coupled to n scan lines S1, S2, . . . , and Sn and n emission control lines E1, E2, . . . , and En arranged in a row direction and m data lines D1, D2, . . . , and Dm arranged in a column direction. The pixels 1 are also electrically coupled to a first power source line L1 and a second power source line L2 for respectively supplying power from a first power source ELVdd and a second power source ELVss to the display region 100. In FIG. 2, the second power source line L2 is equivalently represented. In practice, the second power source line L2 may be formed in the entire region of the display region 100 to be electrically coupled to each pixel 1.

The controller 200 is composed of a brightness controller 210 and an emission controller 220. The brightness controller 210 generates sense signals corresponding to the brightness of peripheral light to select gamma values in accordance with the sense signals and outputs gamma correcting signals corresponding to the selected gamma values to control the data voltage of each data signal and brightness. On the other hand, the emission controller 220 controls the signal width (e.g., pulse width) of each emission control signal to control the amount of current that flows through the display region 100 and prevents more than a predetermined amount of current from flowing through the display region 100.

The power source supply unit 300 supplies power from the first power source ELVdd through the first power source line L1 and power from the second power source ELVss through the second power source line L2.

The scan driver 400 supplies scan signals to the scan lines S1, S2, . . . , and Sn and controls the signal width of each emission control signal in accordance with the brightness control signals output from the emission controller 220.

The data driver 500 transmits the data signals corrected in accordance with the gamma correcting signals output from the brightness controller 210 to the data lines D1, D2, . . . , and Dm.

Figure 3:
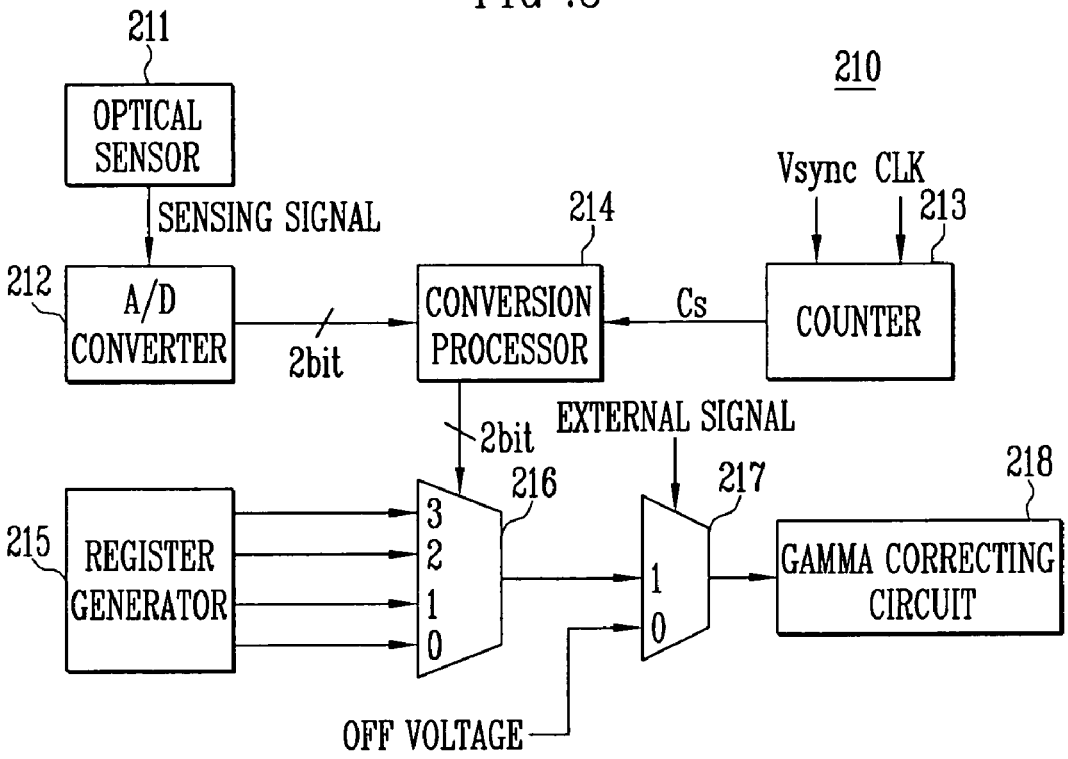
FIG. 3 illustrates an example of a brightness controller used for the light emitting display device according to an exemplary embodiment of the present invention.

FIG. 3 illustrates an example of the brightness controller 210 used for the light emitting display device in an exemplary embodiment according to the present invention.

Referring to FIG. 3, the brightness controller 210 includes an optical sensor 211, an A/D converter 212, a counter 213, a conversion processor 214, a register generator 215, a first selector 216, a second selector 217, and a gamma correcting circuit 218.

The optical sensor 211 measures the brightness of peripheral light and divides the brightness of the peripheral light into a plurality of steps to output analog sense signals corresponding to the brightness of the respective steps.

The A/D converter 212 compares the analog sense signals output from the optical sensor 211 with a set reference voltage and outputs 2-bit digital sense signals in response to the comparison results. For example, in the step where the brightness of the peripheral light is highest, a sense signal of 11 is output. In the step where the brightness of the peripheral light is high, a sense signal of 10 is output. In the step where the brightness of the peripheral light is low, a sense signal of 01 is output. In the step where the brightness of the peripheral light is lowest, a sense signal of 00 is output.

The counter 213 counts predetermined numbers in response to a vertical synchronizing signal Vsync supplied from the outside for a predetermined time to output counting signals Cs corresponding to the numbers. For example, in the case of the counter 213 based on a binary value having 2 bits, the counter 213 is initialized to 00 when the vertical synchronizing signal Vsync is input and counts numbers to 11 while sequentially shifting a clock signal CLK. Then, when the vertical synchronizing signal Vsync is input to the counter 213 again, the counter 213 is initialized again. As described above, the counter 213 sequentially counts the numbers from 00 to 11 in one frame. The counter 213 outputs the counting signals Cs corresponding to the counted numbers to the conversion processor 214.

The conversion processor 214 outputs control signals that select the set values of the respective registers using the counting signals Cs output from the counter 213 and the sense signals output from the A/D converter 212. That is, the conversion processor 214 outputs control signals corresponding to sense signals selected when the counter 213 outputs predetermined signals and maintain the output control signals by the counter 213 in one frame. Then, in the next frame, the conversion processor 214 resets the output control signals and outputs the control signals corresponding to the sense signals output from the A/D converter 212 to maintain the control signals in one frame. For example, the conversion processor 214 outputs a control signal corresponding to the sense signal of 11 when the brightness of the peripheral light is highest and maintains the control signal in one frame counted by the counter 213. The conversion processor 214 outputs a control signal corresponding to the sense signal of 00 when the brightness of the peripheral light is lowest and maintains the control signal in one frame counted by the counter 213. The conversion processor 214 outputs the control signal corresponding to the sense signal of 10 when the brightness of the peripheral light is high and the control signal corresponding to the sense signal of 01 when the brightness of the peripheral light is low and maintains the control signals in one frame.

The register generator 215 divides the brightness of the peripheral light into a plurality of steps to store a plurality of register set values corresponding to the respective steps.

The first selector 216 selects register set values corresponding to the control signals set by the conversion processor 214 among the plurality of register set values stored in the register generator 215.

The second selector 217 receives set values of one bit for controlling on and off from the outside. When 1 is selected, the brightness controller 210 operates. When 0 is selected, the brightness controller 210 is turned off to selectively control brightness in accordance with the peripheral light.

The gamma correcting circuit 218 generates a plurality of gamma correcting signals corresponding to the selected register set values in accordance with the control signals set by the conversion processor 214. At this time, the control signals correspond to the sense signals output from the optical sensor 211 so that the gamma correcting signals have different values in accordance with the brightness of the peripheral light.

The above-described operations are performed for each of R, G, and B electroluminescent (EL) devices.

Figure 4:
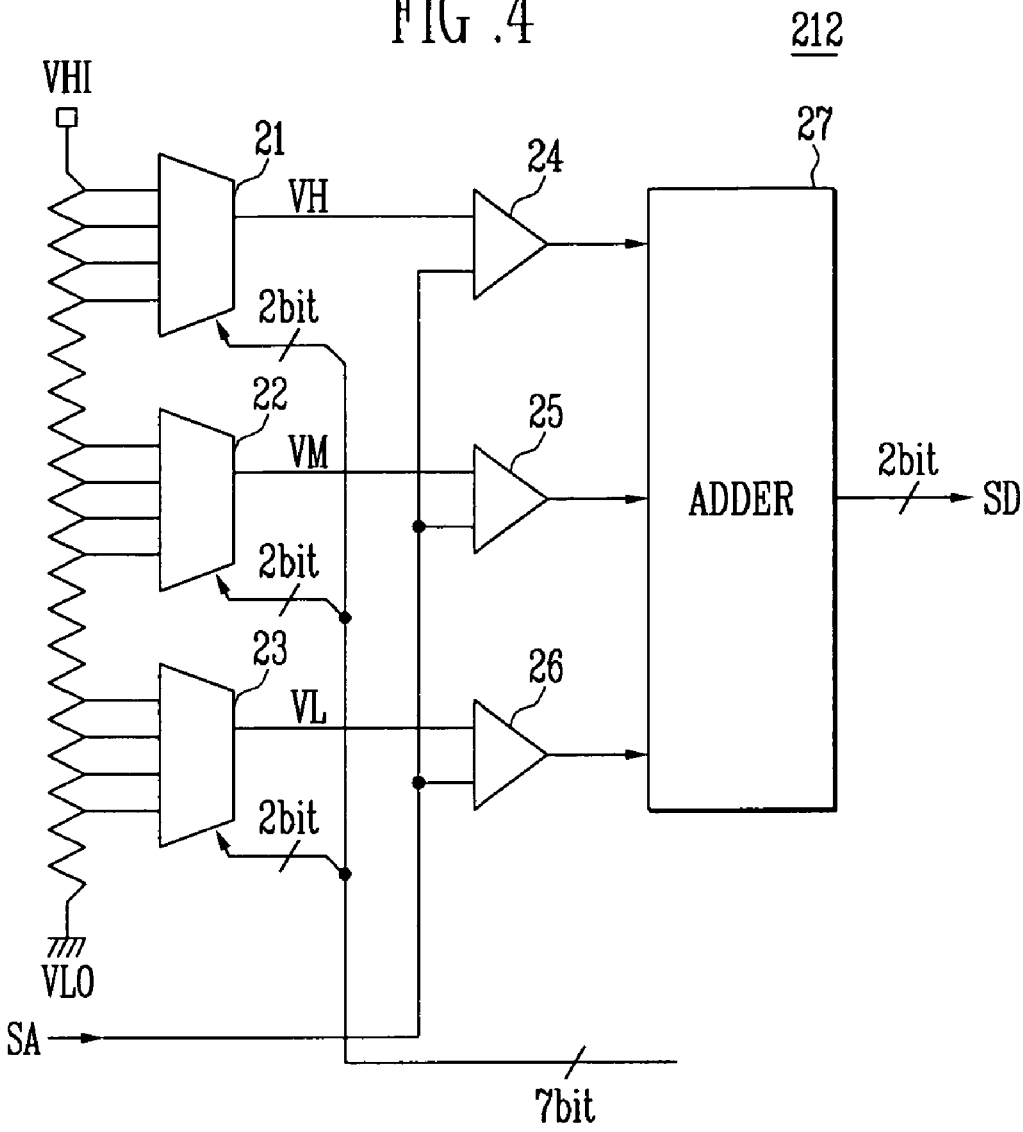
FIG. 4 illustrates an example of an A/D converter used in the brightness controller of FIG. 3.

FIG. 4 illustrates an example of the A/D converter 212 used in the brightness controller 210.

Referring to FIG. 4, the A/D converter 212 includes first to third selectors 21, 22, and 23, first to third comparators 24, 25, and 26, and an adder 27.

The first to third selectors 21, 22, and 23 receive a plurality of data voltages (e.g., gray scale voltages) VHI to VLO distributed through a resistor series including a plurality of resistors, and output data voltages corresponding to different values of 2 bits to determine the data voltages as reference voltages VH to VL.

The first comparator 24 compares an analog sense signal SA with a first reference voltage VH to output a comparison result. For example, the first comparator 24 outputs 1 when the analog sense signal SA is larger than the first reference voltage VH and outputs 0 when the analog sense signal SA is smaller than the first reference voltage VH. In the same way, the second comparator 25 compares the analog sense signal SA with a second reference voltage VM to output a comparison result and the third comparator 26 compares the analog sense signal SA with a third reference voltage VL to output a comparison result.

The adder 27 sums the result values output from the first to third comparators 24, 25 and 26 together to output a result value as a digital sense signal SD having 2 bits.

The region of the analog sense signal SA corresponding to the same digital sense signal SD may vary by changing the first to third reference voltages VH to VL.

When the first, second, and third reference voltages VH, VM, and VL are determined as 3V, 2V, and 1V and it is assumed that the voltage value of the analog sense signal SA is larger accordingly as the brightness of the peripheral light is higher, the A/D converter of FIG. 4 will be described as follows. When the analog sense signal SA is smaller than 1V, the first to third comparators 24, 25 and 26 each output 0 and the adder 27 outputs the digital sense signal SD of 00. When the analog sense signal SA is between 1V and 2V, the first to third comparators 24, 25 and 26 output 0, 0, and 1, respectively, and the adder 27 outputs the digital sense signal SD of 01. In the same way, when the analog sense signal SA is between 2V and 3V, the adder 27 outputs the digital sense signal SD of 10. When the analog sense signal SA is greater than 3V, the adder 27 outputs the digital sense signal SD of 11. This way, the A/D converter divides the brightness of the peripheral light into four steps to output 00 in the darkest step, 01 in the dark step, 10 in the bright step, and 11 in the brightest step.

Figure 5:
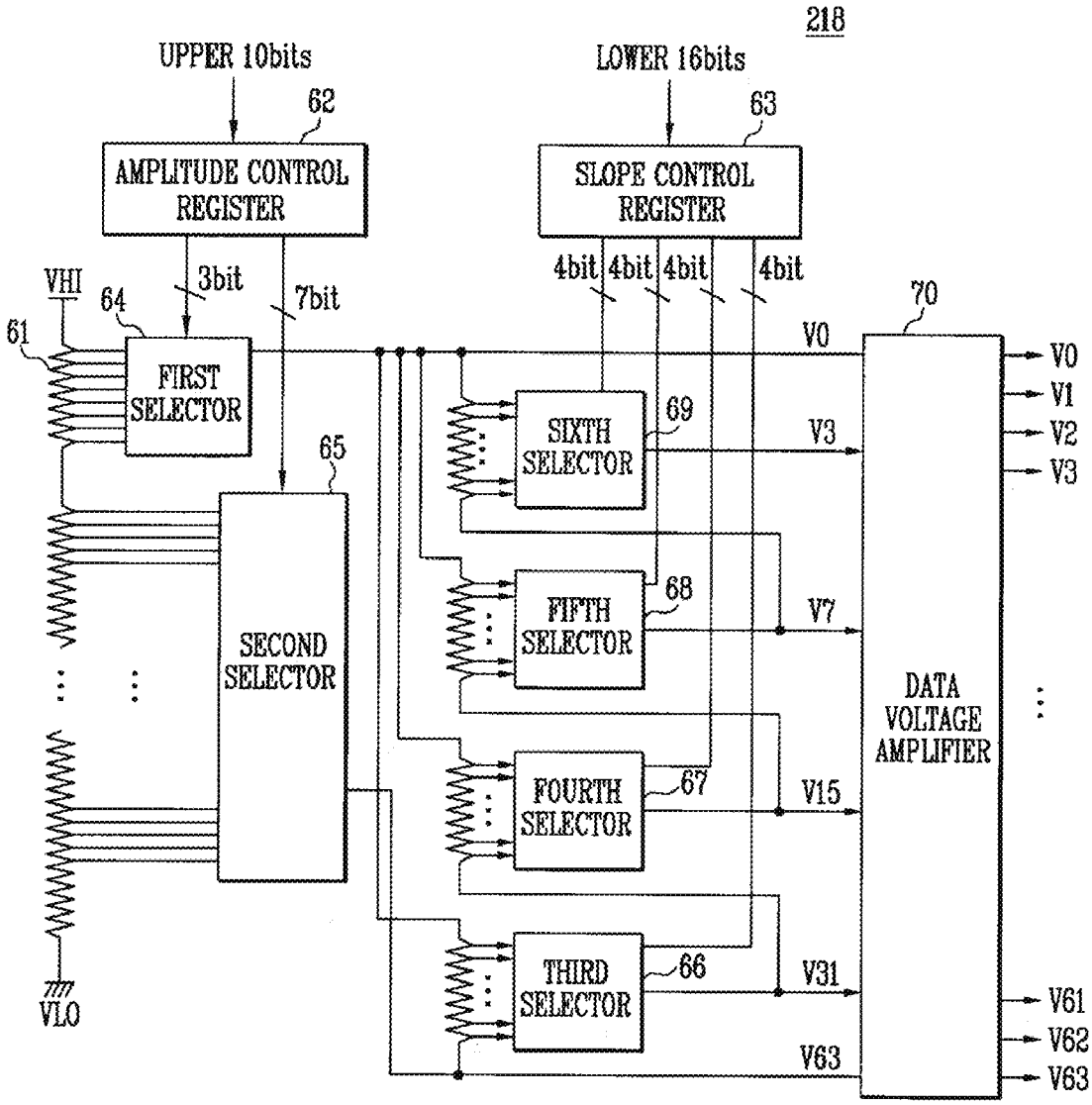
FIG. 5 illustrates an example of a gamma correcting circuit used in the brightness controller of FIG. 3.

FIG. 5 illustrates an example of the gamma correcting circuit 218 used for the brightness controller 210.

Referring to FIG. 5, the gamma correcting circuit 218 includes a ladder resistance 61, an amplitude control register 62, a slope control register 63, first to sixth selectors 64, 65, 66, 67, 68, 69, and a data voltage amplifier 70.

The ladder resistance 61 sets the uppermost level voltage VHI supplied from the outside as a reference voltage. The ladder resistance 61 has a plurality of serially connected variable resistances included between the lowermost level voltage VLO and the reference voltage, and generates a plurality of data voltages (e.g., gray scale voltages) therethrough. When the ladder resistance 61 value is small, an amplitude control range is reduced but a control precision degree improves. When the ladder resistance 61 value is large, the amplitude control range increases but the control precision degree is reduced.

The amplitude control register 62 outputs a register set value having 3 bits to the first selector 64 and outputs a resistor set value having 7 bits to the second selector 65. At this time, it is possible to increase the number of gray scales that can be selected by increasing the number of set bits and to select data voltages by changing the register set values.

The slope control register 63 outputs register set values having 4 bits to the third to sixth selectors 66, 67, 68, 69. At this time, the register set values can vary and can control the data voltages that can be selected in accordance with the register set values.

Among the register values generated by the register generator 215, the upper 10 bits are input to the amplitude control register 62 and the lower 16 bits are input to the slope control register 63 so that the upper 10 bits and the lower 16 bits are selected as the register set values.

The first selector 64 selects the data voltage corresponding to the register set value having 3 bits set by the amplitude control register 62 among the plurality of data voltages distributed through the ladder resistance 61 to output the data voltage as the uppermost data voltage.

The second selector 65 selects the data voltage corresponding to the register set value having 7 bits set by the amplitude control register 62 among the plurality of data voltages distributed through the ladder resistance 61 to output the data voltage as the lowermost data voltage.

The third selector 66 distributes the voltages between the data voltage output from the first selector 64 and the data voltage output from the second selector 65 into the plurality of data voltages through a resistance series and selects the data voltage corresponding to the register set value having 4 bits to output the data voltage.

The fourth selector 67 distributes the voltages between the data voltage output from the first selector 64 and the data voltage output from the third selector 66 into the plurality of data voltages through a resistor series and selects the data voltage corresponding to the register set value having 4 bits to output the data voltage.

The fifth selector 68 selects the data voltage corresponding to the register set value having 4 bits among the data voltages between the first selector 64 an the fourth selector 67 to output the data voltage.

The sixth selector 69 selects the data voltage corresponding to the register set value having 4 bits among the plurality of data voltages between the first selector 64 and the fifth selector 68 to output the data voltage.

As described above, the curves of intermediate level gray scales are controlled in accordance with the register set values of the slope control register 63 so that gamma characteristics are easily controlled in accordance with the characteristics of the respective EL devices. The values of the respective ladder resistance 61 are set so that difference in potential between gray scales is set to be larger accordingly as smaller gray scales are displayed when the gamma curve characteristic is to be concave and that difference in potential between gray scales is set to be smaller accordingly as smaller gray scales are displayed when the gamma curve characteristic is to be convex.

The data voltage amplifier 70 outputs a plurality of data voltages (e.g., gray scale voltages) corresponding to the plurality of gray scales to be displayed on the display region 100. In FIG. 5, the output of data voltages corresponding to 64 gray scales is described.

As described above, the gamma correcting circuit is provided for each of the R, G, and B EL devices so that the R, G, and B EL devices obtain almost the same brightness characteristic in consideration of change in the characteristics of the R, G, and B EL devices. Therefore, the amplitudes and curves of the R, G, and B EL devices can be set differently by the amplitude control register 62 and the slope control register 63.

Figure 6A:
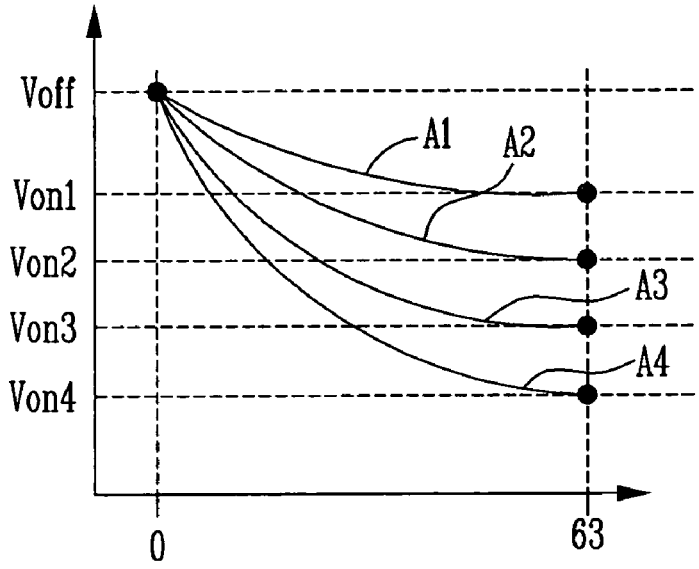
FIGS. 6A and 6B illustrate gamma curves generated by the gamma correcting circuit of FIG. 5.
Figure 6B:
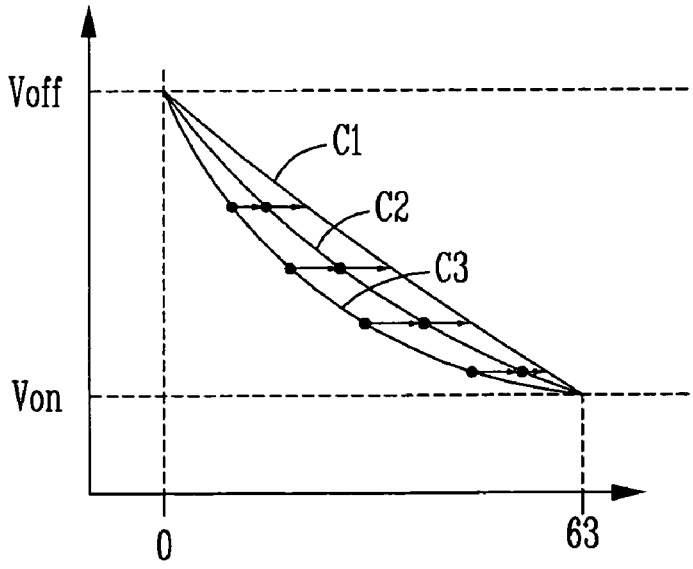

FIGS. 6A and 6B illustrate gamma curves generated by the gamma correcting circuit 218.

Referring to FIGS. 6A to 6B, in FIG. 6A, the upper level data voltages are not changed but the lower level data voltages are changed in accordance with the register set value having 7 bits set by the amplitude control register 62 to control the amplitudes of the lower level data voltages. A gamma curve A1 corresponds to the sense signal in the state where the brightness of the peripheral light is lowest. A gamma curve A2 corresponding to the sense signal in the state where the brightness of the peripheral light is low. A gamma curve A3 corresponds to the sense signal in the state where the brightness of the peripheral light is high. A gamma curve A4 corresponds to the sense signal in the state where the brightness of the peripheral light is highest. In the gamma curves A1, A2, A3 and A4, an off voltage Voff corresponds to a black gray scale level (i.e., gray scale value of 0) and on voltages Von1, Von2, Von3 and Von4, respectively, correspond to a white gray scale level (i.e., gray scale value of 63). When the amplitudes of the data voltages are to be controlled to be small, the register set value of the amplitude control register 62 is controlled so that the second selector selects the highest level voltage. Also, when the amplitudes of the data voltages are to be controlled to be large, the register set value of the amplitude control register 62 is controlled so that the second selector selects the lowest level voltage.

In FIG. 6B, the upper level data voltages and the lower level data voltages are not changed in accordance with the register set value set by the slope control register 63 but only intermediate level data voltages are changed to control gamma curves. The register set value having 4 bits is input to the third to sixth selectors 33, 34, 36, 36 and four gamma values corresponding to the register set value are selected to generate the gamma curves. The off voltage Voff corresponds to a black gray scale level (i.e., gray scale value of 0) and on voltage Von corresponds to a white gray scale (i.e., gray scale value of 63). Change in the slope of a curve C2 is larger than change in the slope of a curve C1, and is smaller than change in the slope of a curve C3. It is noted from FIGS. 6A and 6B that the data voltages are changed by changing the set values of the gamma control register to generate the gamma curves so that the brightness of the pixels 1 included in the display region 100 can be controlled.

Figure 7:
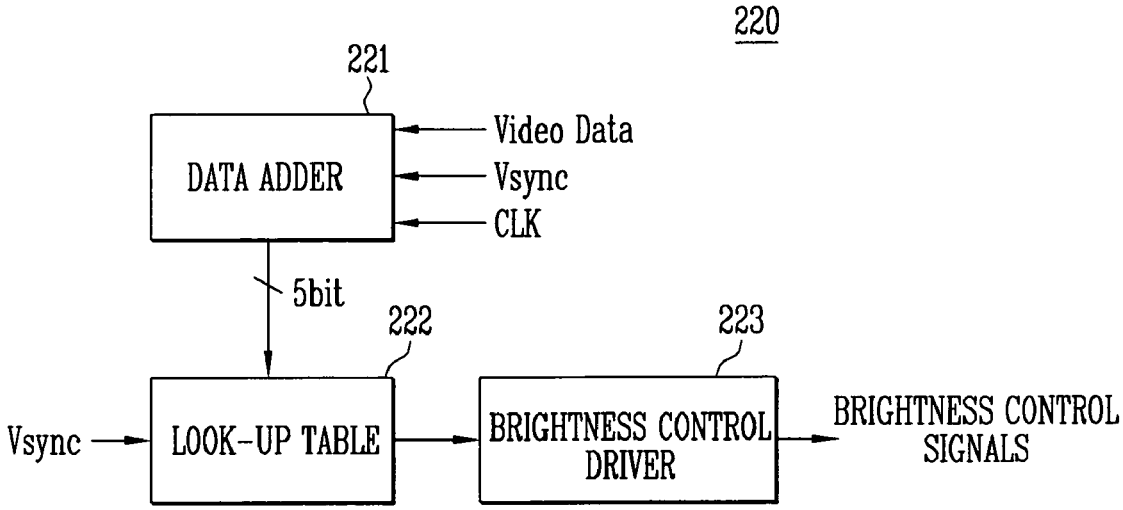
FIG. 7 illustrates an example of an emission controller used in the controller of FIG. 2.

FIG. 7 illustrates an example of the emission controller 220 used in the controller 200 of FIG. 2.

Referring to FIG. 7, the emission controller 220 controls the brightness of the display region in accordance with an emission ratio of the display region. The emission controller 220 includes a data adder 221, a look-up table 222, and a brightness control driver 223.

The data adder 221 determines the magnitude of frame data, which is the value obtained by summing the video data input to the pixels 1 that emit light in one frame. That is, the video data input to the plurality of pixels 1 that emit light in one frame are added to each other and their sum is referred to as the frame data. When the magnitude of the frame data is large, it means that the emission ratio of the display region 100 is high or that there are many pixels 1 that display high gray scale images. That is, since it means that the amount of current that flows through the entire display region 100 is large when the magnitude of the frame data is large, when the magnitude of the frame data is greater than or equal to a predetermined value, the brightness of the display region 100 is controlled to reduce the brightness of the entire display region 100.

When the brightness of the display region 100 becomes lower, the pixels 1 that emit light have high brightness so that a difference in brightness between the pixels 1 that emit light and the pixels 1 that do not emit light is large, that is, the contrast ratio is large. On the other hand, when the brightness of the display region 100 does not become lower, the emission time of the pixels 1 that emit light is maintained long so that the brightness of the pixels 1 that emit light becomes high. Therefore, the contrast ratio between the pixels 1 that emit light and the pixels 1 that do not emit light is large. That is, the contrast ratio between the pixels 1 that emit light and the pixels 1 that do not emit light is larger so that images can be seen clearly.

The look-up table 222 stores information on the ratio between the emission period and the non-emission period of the emission control signals corresponding to the upper 5-bit values of the frame data. It is possible to determine the brightness of the display region 100 that emits light in one frame using the information stored in the look-up table 222.

The brightness control driver 223 outputs brightness control signals when the magnitude of the frame data of the display region 100 is greater than or equal to a predetermined magnitude and controls the ratio between the emission period and the non-emission period of the emission control signals input to the display region 100 in response to the output brightness control signals. At this time, when the brightness control ratio continuously increases in proportion to increase in the brightness of the display region 100, when the brightness of the display region 100 is very high, it may not be possible to provide a bright enough screen due to excessive brightness control so that the entire brightness becomes lower. Therefore, the maximum control range of brightness is set so that the brightness of the entire display region 100 is properly controlled.

FIG. 8 illustrates an example of the look-up table 222 according to an exemplary embodiment of the present invention.

In the look-up table 222 of FIG. 8, the emission ratio is limited to 50% of the maximum value in accordance with the brightness of the display region 100. Referring to FIG. 8, in the described embodiment, when the ratio of the region that emits light in the display region 100 to the entire display region 100 is greater than 36%, the brightness of the display region 100 is limited so that, when the area that emits light at the maximum brightness increases in the display region 100, the ratio that limits brightness increases accordingly. At this time, the ratio of the region that emits light is a variable determined by EQUATION 1.

$$\text{Emission Ratio} = \frac{\text{Brightness of pixel unit that emits light in one frame}}{\text{Brightness of pixel unit that emits light in white}} \quad \text{[EQUATION 1]}$$

In order to prevent excessive restriction on brightness, the maximum restriction ratio in the described embodiment is limited to 50% so that, even if most of the pixels 1 emit light at maximum brightness, the brightness restriction ratio is no more than 50%.

Figure 9:
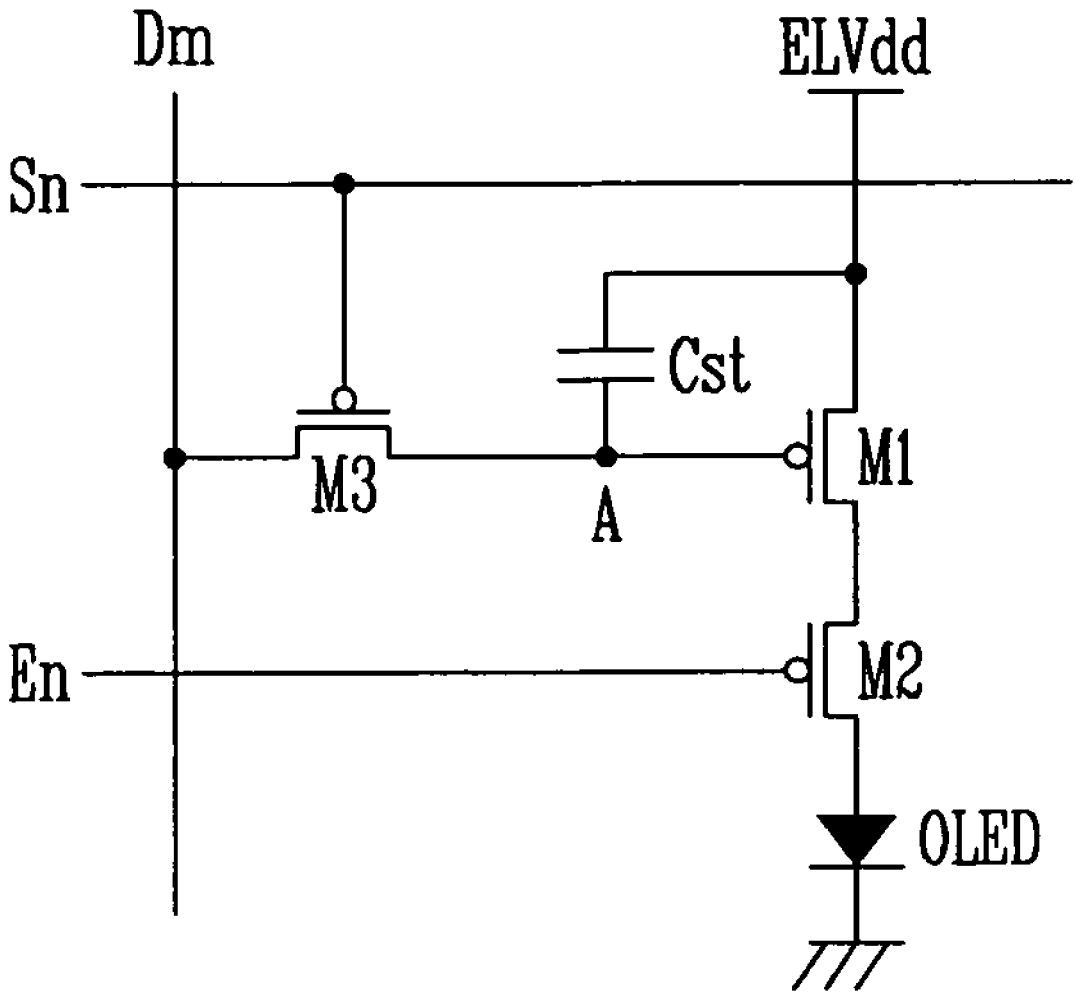
FIG. 9 illustrates an example of a pixel used for the light emitting display device of FIG. 2.

FIG. 9 illustrates an example of the pixel 1 used for the light emitting display device of FIG. 2.

Referring to FIG. 9, the pixel 1 includes an organic light emitting diode (OLED) and a pixel circuit. The pixel circuit includes a first transistor M1, a second transistor M2, a third transistor M3, and a storage capacitor Cst. Each of the first transistor M1, the second transistor M2, and the third transistor M3 includes a gate, a source, and a drain, and the storage capacitor Cst includes a first electrode and a second electrode.

The source of the first transistor M1 is connected to a first power source ELVdd. The drain of the first transistor M1 is connected to the source of the second transistor M2. The gate of the first transistor M1 is connected to a first node A. The first node A is connected to the drain of the third transistor M3. The first transistor M1 supplies the current corresponding to a data signal to the OLED.

The source of the second transistor M2 is connected to the drain of the first transistor M1. The drain of the second transistor M2 is connected to the anode electrode of the OLED. The gate of the second transistor M2 is connected to an emission control line En to respond to an emission control signal. Therefore, the second transistor M2 controls the flow of current that flows from the first transistor M1 to the OLED in accordance with the emission control signals to control the emission of the OLED.

The source of the third transistor M3 is connected to a data line Dm. The drain of the third transistor M3 is connected to the first node A. The gate of the third transistor M3 is connected to a scan line Sn. The third transistor M3 transmits the data signal to the first node A in accordance with a scan signal applied to the gate of the third transistor M3.

The first electrode of the storage capacitor Cst is connected to the first power source ELVdd and the second electrode of the storage capacitor Cst is connected to the first node A. The storage capacitor Cst stores charge in accordance with the data signal and applies a signal to the gate of the first transistor M1 in one frame due to the stored charge so that the operation of the first transistor M1 is maintained in one frame.

While the present invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A light emitting display device comprising:

a display region including a pixel adapted to emit light in response to a data signal, a scan signal, and an emission control signal;

a controller for controlling brightness of the display region;

a scan driver for supplying the scan signal and for controlling a signal width of the emission control signal in accordance with a signal output from the controller;

a data driver for supplying the data signal corresponding to video data, the data signal being corrected using a gamma correcting signal output from the controller; and a power source supply unit for supplying power to the display region, wherein the controller outputs the gamma correcting signal corresponding to peripheral light and controls an amount of current supplied to the display region in accordance with a sum of the video data in one frame, wherein the controller comprises a brightness controller for selecting a gamma correcting value in accordance with brightness of the peripheral light to control the data signal using the gamma correcting signal corresponding to the gamma correcting value; and an emission controller for controlling the amount of current supplied to the display region in accordance with the sum of the video data, and wherein the brightness controller comprises:

an optical sensor for outputting an analog sense signal corresponding to the brightness of the peripheral light;

an A/D converter for converting the analog sense signal to a digital sense signal;

a counter for counting a predetermined number in one frame to generate a counting signal corresponding to the counted number;

a conversion processor for outputting a control signal corresponding to the digital sense signal and the counting signal;

a register generator for dividing the brightness of the peripheral light into a plurality of steps to store a plurality of register set values corresponding to the respective steps;

a first selector for selecting one register set value among the plurality of register set values stored in the register generator in response to the control signal set by the conversion processor to output the one register set value; and a gamma correcting circuit for generating the gamma correcting signal in accordance with the control signal of the conversion processor.

2. The light emitting display device as claimed in claim 1, wherein the brightness controller comprises a second selector for controlling on and off of the brightness controller.

3. The light emitting display device as claimed in claim 1, wherein the data signal is controlled in accordance with the gamma correcting signal output from the brightness controller.

4. The light emitting display device as claimed in claim 1, wherein the gamma correcting circuit comprises:

an amplitude control register for controlling an upper level data voltage and a lower level data voltage in accordance with register set bits;

a slope control register for selecting intermediate level data voltages in accordance with the register set bits to control gamma curves;

a first selector for selecting the upper level data voltage in accordance with the register set bits set by the amplitude control register;

a second selector for selecting the lower level data voltage in accordance with the register set bits set by the amplitude control register;

third, fourth, fifth and sixth selectors for outputting the intermediate level data voltages in accordance with the register set bits set by the slope control register; and a data voltage amplifier for outputting a plurality of data voltages corresponding to plurality of gray scale levels to be displayed.

5. The light emitting display device as claimed in claim 1, wherein the emission controller comprises:

a data adder for summing the video data in one frame to generate frame data;

a look-up table for storing information on brightness control of the display region in accordance with a magnitude of the frame data; and a brightness control driver for outputting a brightness control signal in accordance with information stored in the look-up table to control a ratio between an emission period and a non-emission period of the emission control signal.

6. The light emitting display device as claimed in claim 5, wherein the look-up table maintains the ratio of the emission control signal corresponding to upper 5-bit values of the frame data in one frame.

7. The light emitting display device as claimed in claim 5, wherein the look-up table is applied to a current frame based on information on an immediately previous frame.

8. The light emitting display device as claimed in claim 7, wherein the look-up table stores information corresponding to R, G, and B electroluminescent (EL) devices.

9. The light emitting display device as claimed in claim 5, wherein the data adder generates the frame data with respect to R, G, and B EL devices.

10. The light emitting display device as claimed in claim 5, wherein the ratio between the emission period and the non-emission period of the display region is determined in accordance with the magnitude of the frame data.

11. The light emitting display device as claimed in claim 1, wherein the gamma correcting signal is controlled in accordance with a sense signal corresponding to the peripheral light to control brightness of the pixel.

12. The light emitting display device as claimed in claim 1, wherein a ratio between an emission period and a non-emission period of the emission control signal decreases as a magnitude of the sum of the video data increases.

13. The light emitting display device as claimed in claim 12, wherein the ratio between the emission period and the non-emission period of the emission control signal is not decreased when a ratio between an area of the display region that emits light and a total area of the display region is less than a predetermined ratio.

14. The light emitting display device as claimed in claim 12, wherein the ratio between the emission period and the non-emission period of the emission control signal is not decreased below a predetermined ratio.

* * * * *